US005585830A

United States Patent [19]

De Clerck et al.

[11] Patent Number: 5,585,830

[45] Date of Patent: Dec. 17, 1996

[54] METHOD FOR MAKING PRINTS BY MEANS OF A THERMAL PRINTER

[75] Inventors: Marc De Clerck, Borsbeek; Jan Zwijsen, Wilrijk, both of Belgium

[73] Assignee: Agfa-Gevaert N.V., Mortsel, Belgium

[21] Appl. No.: 410,990

[22] Filed: Mar. 27, 1995

[30] Foreign Application Priority Data

Apr. 29, 1994 [EP] European Pat. Off. ..... 94201179

[51] Int. Cl.[6] ..... B41J 2/325

[52] U.S. Cl. ..... 347/171

[58] Field of Search ..... 347/171, 172, 347/174, 176, 218; 346/138; 400/120.01, 120.02, 120.04

[56] References Cited

U.S. PATENT DOCUMENTS 4,666,320 5/1987 Kobayashi et al. ..... 347/176
4,751,519 6/1988 Shimada et al. ..... 347/176

FOREIGN PATENT DOCUMENTS 0582058 2/1994 European Pat. Off. .

*Primary Examiner*—Huan H. Tran
*Attorney, Agent, or Firm*—Brumbaugh, Graves, Donohue & Raymond

[57] ABSTRACT

In making prints by thermal printing, a rectangular print-receiving sheet is attached with its leading edge onto a rotatable print drum while leaving the trailing edge of the sheet unattached. The two corners at the trailing edge are rounded.

5 Claims, 3 Drawing Sheets

METHOD FOR MAKING PRINTS BY MEANS OF A THERMAL PRINTER

BACKGROUND OF THE INVENTION

1. Field of the Invention

The present invention relates to a thermal image-recording apparatus which comprises a thermal print head.

2. Description of the Prior Art

In the thermal printing process, a dye-bearing donor ribbon is brought into contact with a dye-receiving print sheet at a print zone. Thermal printing is effected by contacting the donor ribbon with a multi-element print head which spans the ribbon in a direction transverse to the direction of ribbon travel. The print head typically comprises a linear array of closely spaced resistive heating elements, each being independently addressable by an applied voltage to heat that portion of the donor ribbon directly opposite and thereby cause dye to transfer from the ribbon to the print sheet.

The print sheet is wrapped about the surface of a rotatable print drum. Only the leading edge of this sheet is clamped on the surface of the drum (leading: i.e. considered according to the direction of rotation of the drum), whereas angular wrapping as such of the sheet occurs spontaneously as the sheet is sandwiched between the drum surface and the donor ribbon at the print zone.

The printing process described hereinbefore can be used for producing opaque as well as transparent prints. The former are prints on white or coloured paper that are intended for direct reading, whereas the latter can be so-called overhead projection prints for optical projection on a screen, or transparencies for medical diagnosis on a light box, e.g. prints of echographic (ultrasound) or NMR (nuclear magnetic resonance) examinations of a patient.

The donor ribbon is in the form of a web-type dye-carrier containing a series of spaced frames of different coloured heat-transferable dyes, wound on a supply spool. The ribbon is paid out from the supply spool and rewound on a take-up spool. The dye ribbon is difficult to handle and very vulnerable since it has typically a thickness in the order of magnitude of 8 to 10 micrometers only, in order not to impede the heat transfer from the heating elements towards the print sheet. For that reason, the supply spool and the take-up spool are usually provided in a dedicated cassette which has a large central opening allowing the print head to urge the ribbon in contact with the print sheet.

It has been shown that the donor ribbon can become damaged by contact with the trailing edge of the print sheet prior to the dye transfer, viz. in the zone of the central opening of the cassette extending between the supply spool and the print head. Said edge being not attached to the print drum, the trailing end of the sheet moves away from the drum under the influence of the inherent stiffness of the sheet.

The problem is particularly harmful in colour printing since in such case the print drum makes four revolutions for printing in succession a yellow, a magenta, a cyan and possibly a black separation image, and each revolution of the drum involves the risk of damage of the corresponding frame of the dye ribbon.

Arrangement of a thermal printer to have the leading as well as the trailing end of a print sheet attached to the drum would seriously complicate the construction of the machine.

OBJECT OF THE INVENTION

The present invention aims an improved method for making prints by thermal dye transfer, from a dye-bearing donor ribbon on a print sheet, which is not subject to the defect described hereinbefore.

STATEMENT OF THE INVENTION

In accordance with the present invention, a method for making prints by means of a thermal printer, which comprises the steps of attaching a rectangular print-receiving sheet with its leading edge onto a rotatably print drum while leaving the trailing end of the sheet unattached, rotating said drum with the print-receiving sheet carried thereby in front of a thermal print head while a dye-bearing donor ribbon is squeezed between the print head and the sheet thereby to produce dye transfer from the ribbon to the sheet upon selective heating of the print head, is characterised by the use of a print-receiving sheet of which at least the two trailing corners in the printer are rounded.

We have found that the inventive measure effectively avoids any risk of damaging the dye ribbon, even in those cases where the print sheet is stiff and tough, e.g. a polyethylene terephthalate foil. Yet polyester is preferred as a support for transparent prints since it combines a relatively low cost price with dimensional stability and toughness.

The application of the method according to the invention is not limited to transparent print sheets, and thus paper sheets, so-called resin-coated paper sheets and the like can be used as well in the method of the invention.

Suitable embodiments of the invention are as follows.

The radius of curvature of the two trailing corners of the print sheet is at least 3 mm.

The four corners of the print sheet are rounded.

The invention will be described hereinafter by way of example with reference to the accompanying drawings, wherein:

FIG. 1 is a diagrammatic representation of one embodiment of a thermal image-recording apparatus according to the present invention, the print head being in the operative position, FIG. 2 shows the apparatus of FIG. 1 with the print head in the inoperative position, FIG. 3 shows a plan view of a section of the dye ribbon and the underlying print-receiving sheet, and FIG. 4 shows enlarged detail 4 of FIG. 3.

DETAILED DESCRIPTION OF THE INVENTION

Figure 1:
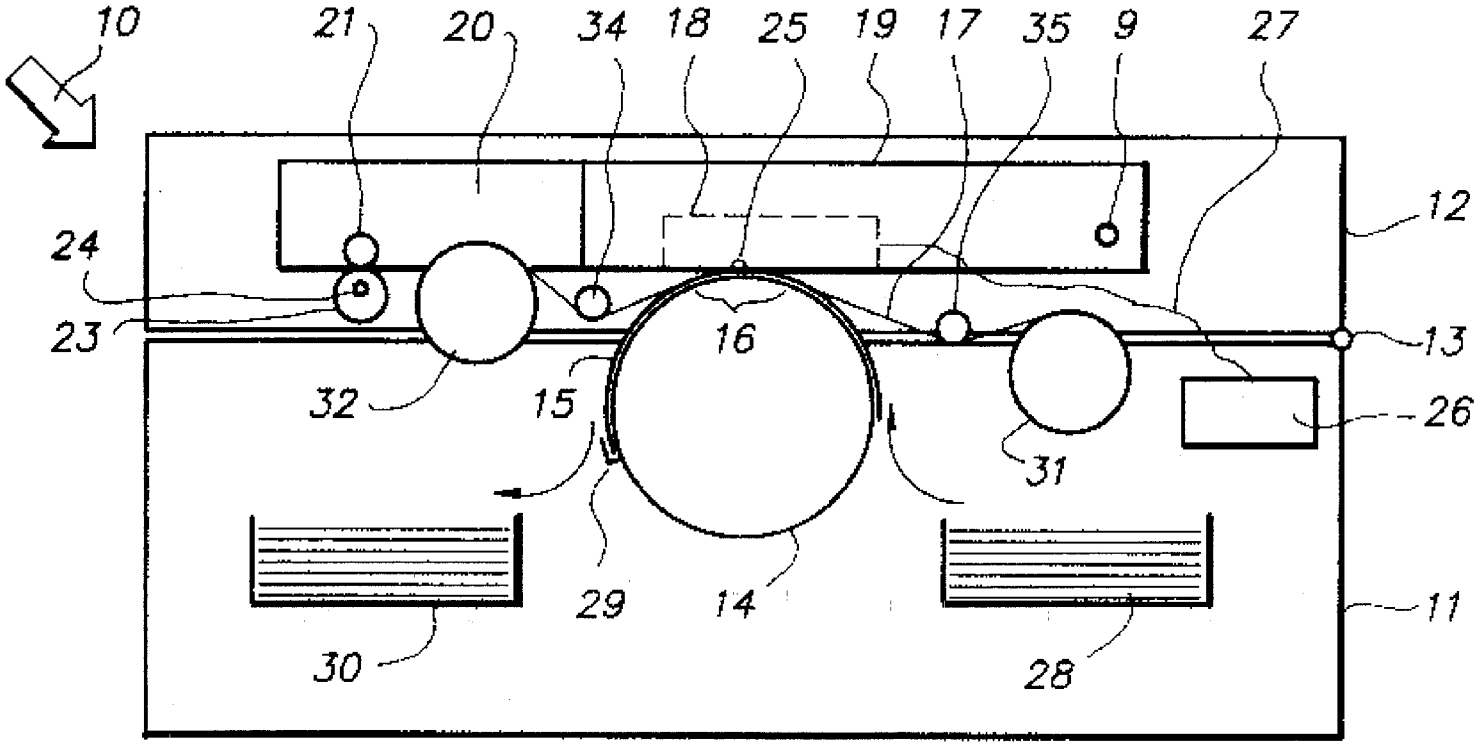

FIG. 1 shows a diagrammatic representation of one embodiment of a thermal image-recording apparatus according to the present invention.

The apparatus is a so-called thermosublimation printer mounted in a housing 10 having a base 11 and a lid 12 hinged to the base at 13, and generally comprises a cylindrical print drum 14 which supports and transports a print-receiving sheet 15 through a print zone 16 where it receives thermally printed information.

Thermal printing is effected by advancing a dye-bearing donor ribbon 17 through the print zone between the print-receiver sheet 15 and a print head 18.

Figure 2:
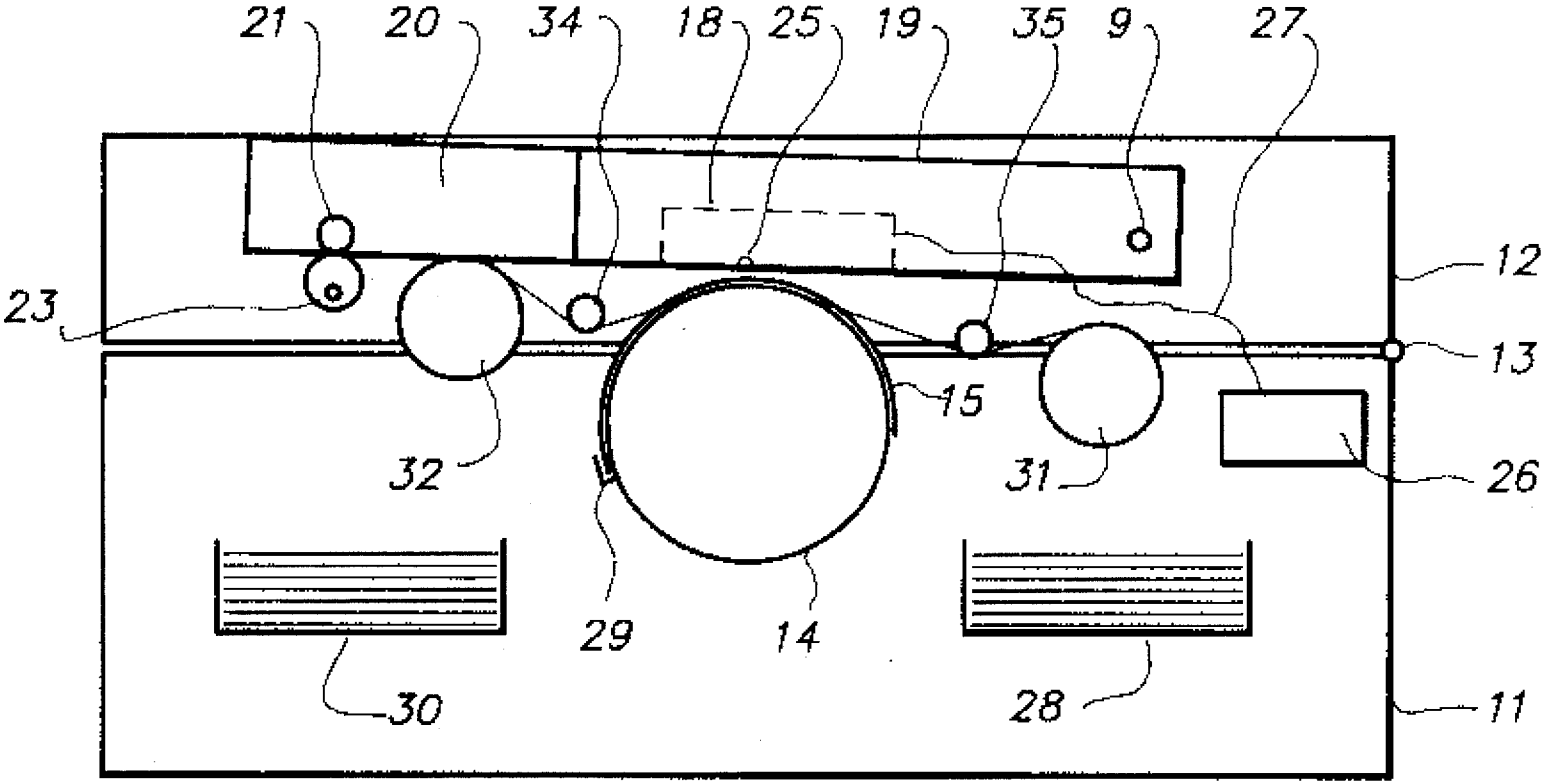

The print head is shown in broken lines and is mounted in a subhousing 19 mounted in lid 12 and pivotable about a pin 9. The subhousing has two arms 20 spaced in parallel, which are interconnected by a rod 21. Rod 21 rests on a cam 23 mounted on shaft 24 equally mounted with its driving motor (not shown) in lid 12. Rotation of the cam brings the print head from its print position in which it presses against the print drum and the media therebetween (see FIG. 1), into a non-printing position in which the print head is spaced from the print drum (see FIG. 2).

Print head 18 spans the print drum and is of conventional design, comprising a lienar array 25 (see FIG. 4) of closely spaced resistive elements, each being independently addressable with image information by an applied voltage supplied by a microprocessor 26 connected via cable 27. As each resistive element is addressed, it heats that portion of the donor ribbon directly opposite, thereby causing dye to be transferred from the donor ribbon to the print receiver sheet. In colour thermal printers, the donor ribbon usually comprises patches of yellow, magenta, cyan and possibly black dyes in a repeating series, and the print-receiving sheet is rotated three or four times through the print zone to receive a full-colour image. The print receiver sheets are fed to the drum from a sheet supply 28 and are clamped with their leading edge to the drum by a suitable clamping mechanism 29. Upon receiving the thermal image, the clamping mechanism releases the print receiver sheet allowing it to enter an output tray 30, which has been illustrated within the housing but which may be located in front of the apparatus as well. Print drum 14 is rotatably driven by a precision stepper motor which in turn is controlled by microprocessor 26. The microprocessor also controls the position of the subhousing, via cam 23, so as to move print head 18 to its nonprinting position to allow passage of the clamping mechanism through the print zone.

The dye-bearing donor ribbon 17 is fed from a supply spool 31 to a take-up spool 32 driven by a suitable motor. Both spools can be fitted in a disposable cassette for ease of handling, as known in the art, which is located in base 11 of the apparatus. Rollers 34 and 35 controlling the path of the dye-donor ribbon about drum 14 move together with lid 12.

In operation of the apparatus, print-receiving sheet 15 does not occupy a position on drum 14 as shown, but deviates rather strongly from such concentric position because its trailing edge is not attached to the drum. These deviations of the sheet from its correct position are not harmful for the sheet since its image-receiving surface is not very vulnerable. In any way, suitable guide fingers and the like can easily keep the sheet position under control.

Control of the trailing portion of the sheet in the region of the print head, on the contrary, is not possible since there is no room for guide fingers or deflectors. Thereby it can occur that the trailing sheet portion which is remote of the print drum, and in particular the trailing edge thereof touches the stretch of the dye ribbon extending between roller 35 and print elements 25. We have found that contact with the trailing sheet edge as such is less harmful, but that contact with the corner portions of said edge can seriously damage the corresponding colour patch of the ribbon, and thereby cause defects in the final image by the lacking of color dyes.

Figure 3:
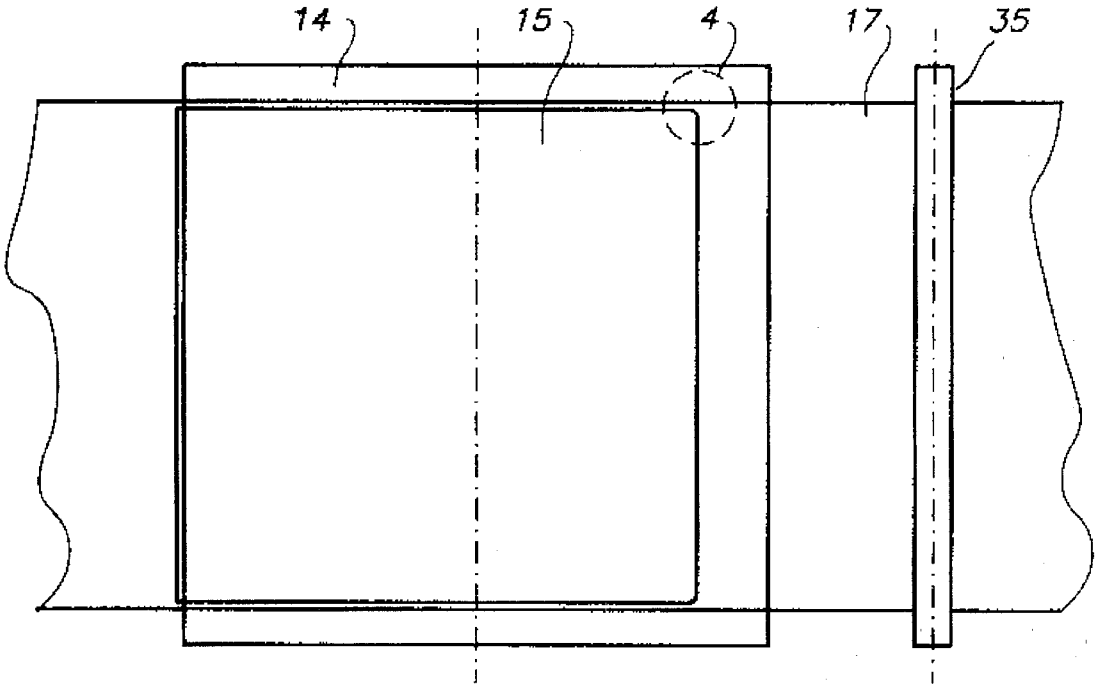

FIG. 3 is a top view of the bar of the apparatus, the lid being completely swung away, and the dye ribbon and the print-receiving sheet being shown as transparent for the ease of representation. Sheet 15 is slightly smaller than ribbon 17 in the present drawing, but it will be understood that both elements can have equal widths.

Figure 4:
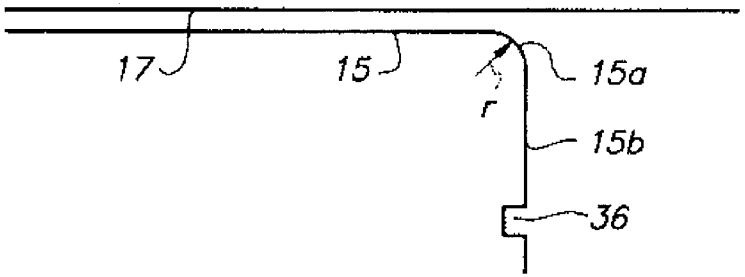

The method according to the invention is illustrated in FIG. 4, which is an enlarged view of detail 4 of FIG. 3. One corner 15*a* only of trailing edge 15*b* of the sheet is shown, but the other trailing corner is rounded accordingly. The radius of curvature r may take many values, but a suitable magnitude is between 3 and 14 mm for sheet formats ranging between 203.2×254.0 and 355.6×431.8

The rounding of the corners is not necessarily circular, and thus otherwise curved corners can be used as well.

The method according to the invention is not limited to the use of a print receiving sheet having two rounded corners and as a matter of fact four rounded corners are preferred because in that case either side of the sheet may be leading or trailing.

A print-receiving sheet for use in the method according to the invention can further be provided with notches or the like for identification of the print-receiving side of a sheet in the printer. An example of suchlike notch is indicated by numeral 36 in FIG. 4.

More details about improvements in a thermal printer of a type as described diagrammatically hereinbefore can be found in the following patent applications :

EP Appl. No. 92 203 896.3, filed Dec. 14, 1992 for a locking mechanism for fastening the print head in a thermal printer:

EP Appl. No. 92 203 893.0, filed Dec. 14, 1992 for a mechanism controlling the winding tension of the dye ribbon:

EP Appl. No. 92 203 297.9, filed Oct. 22, 1992 for a dye ribbon package for use with a thermal printer;

EP Appl. No. 92 203 894.8, filed Dec. 14, 1992 for a thermal print head mounted in a subhousing thereby to keep cooling air out of the main housing of the printer.

We claim:

1. A method for making prints by means of a thermal printer, which comprises the steps of attaching a substantially rectangular print-receiving sheet having a leading end with a leading edge and a trailing end with a trailing edge onto a rotatable print drum by the leading edge while leaving the trailing end of the sheet unattached, the sheet having two leading corners at the leading edge and two trailing corners at the trailing edge, the trailing corners being rounded; and rotating said drum with the print-receiving sheet carried thereby in front of a thermal print head while a dye-bearing donor ribbon is squeezed between the print head and the sheet thereby to produce dye transfer from the ribbon to the sheet upon selective heating of the print head.

2. The method according to claim 1, wherein said two rounded trailing corners each have a radius of curvature measuring at least 3 mm.

3. The method according to claim 1, wherein all four corners of the print-receiving sheet are rounded.

4. The method according to claim 1, wherein said print-receiving sheet has at least one notch.

5. The method according to claim 1, wherein said print receiving sheet is a polyester support provided with a suitable subbing layer for receiving a dye image.

* * * * *

UNITED STATES PATENT AND TRADEMARK OFFICE

CERTIFICATE OF CORRECTION

PATENT NO. : 5,585,830

DATED : December 17, 1996

INVENTOR(S) : De Clerck et al.

It is certified that error appears in the above-identified patent and that said Letters Patent is hereby corrected as shown below:

Column 2, line 9, "rotatably" should read --rotatable--;

Column 4, line 4, "431.8" should read --431.8 mm.--.

Signed and Sealed this

Thirteenth Day of May, 1997

*Attest:*

*Attesting Officer*

BRUCE LEHMAN

*Commissioner of Patents and Trademarks*